US011391113B2

(12) United States Patent
Al-Mousa et al.

(10) Patent No.: US 11,391,113 B2
(45) **Date of Patent: *Jul. 19, 2022**

(54) TANDEM CEMENT RETAINER AND BRIDGE PLUG

(71) Applicant: Saudi Arabian Oil Company, Dhahran (SA)

(72) Inventors: Ahmed Al-Mousa, Dhahran (SA); Marius Neacsu, Dhahran (SA); Ahmed A. Al-Ramadhan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 8 days.

This patent is subject to a terminal disclaimer.

(21) Appl. No.: 17/066,289

(22) Filed: Oct. 8, 2020

(65) Prior Publication Data

US 2021/0025259 A1 Jan. 28, 2021

Related U.S. Application Data

(63) Continuation of application No. 16/103,447, filed on Aug. 14, 2018, now Pat. No. 10,837,254.

(51) Int. Cl.

| | |
|---|---|
| ***E21B 33/124*** | (2006.01) |
| ***E21B 33/129*** | (2006.01) |
| ***E21B 33/134*** | (2006.01) |
| ***E21B 33/138*** | (2006.01) |
| ***E21B 33/12*** | (2006.01) |
| ***E21B 23/06*** | (2006.01) |
| ***E21B 47/117*** | (2012.01) |
| ***E21B 34/14*** | (2006.01) |
| *E21B 34/10* | (2006.01) |

(52) U.S. Cl.

CPC ..... *E21B 33/124* (2013.01); *E21B 23/06* (2013.01); *E21B 33/1204* (2013.01); *E21B 33/1293* (2013.01); *E21B 33/134* (2013.01); *E21B 33/138* (2013.01); *E21B 47/117* (2020.05); *E21B 34/10* (2013.01); *E21B 34/14* (2013.01); *E21B 2200/04* (2020.05)

(58) Field of Classification Search

CPC .... E21B 33/124; E21B 23/06; E21B 33/1204; E21B 33/1293; E21B 33/134; E21B 33/138

See application file for complete search history.

(56) References Cited

U.S. PATENT DOCUMENTS

| | | | |
|---|---|---|---|
| 1,896,482 | A | 2/1933 | Crowell |
| 2,121,002 | A | 6/1938 | Baker |
| 2,187,487 | A | 1/1940 | Burt |

(Continued)

FOREIGN PATENT DOCUMENTS

| | | |
|---|---|---|
| WO | WO 2017043977 | 3/2017 |
| WO | WO 2018017104 | 1/2018 |

OTHER PUBLICATIONS

GCC Examination Report in Gulf Cooperation Council Appln. No. GC 2019-38103, dated Sep. 8, 2020, 7 pages.

(Continued)

*Primary Examiner* — Blake Michener

(74) *Attorney, Agent, or Firm* — Fish & Richardson P.C.

(57) ABSTRACT

A downhole tool assembly including a bridge plug and a cement retainer in tandem to be deployed into a wellbore on the same run or trip for remedial cementing of the wellbore.

15 Claims, 7 Drawing Sheets

(56) References Cited

U.S. PATENT DOCUMENTS

| | | | | |
|---|---|---|---|---|
| 2,189,697 | A | 2/1940 | Baker | |
| 2,327,092 | A | 8/1943 | Botkin | |
| 2,672,199 | A | 3/1954 | McKenna | |
| 2,806,532 | A | 9/1957 | Baker | |
| 4,349,071 | A | 9/1982 | Fish | |
| 4,391,326 | A | 7/1983 | Greenlee | |
| 4,538,684 | A | 9/1985 | Sheffield | |
| 4,735,268 | A * | 4/1988 | Harris | E21B 23/06 166/124 |
| 4,834,184 | A | 5/1989 | Streich et al. | |
| 4,928,762 | A | 5/1990 | Mamke | |
| 4,953,617 | A | 9/1990 | Ross et al. | |
| 5,178,219 | A | 1/1993 | Streich et al. | |
| 5,330,000 | A | 7/1994 | Givens et al. | |
| 6,491,108 | B1 | 12/2002 | Slup et al. | |
| 6,595,289 | B2 | 7/2003 | Tumlin et al. | |
| 7,424,909 | B2 | 9/2008 | Roberts et al. | |
| 7,600,572 | B2 | 10/2009 | Slup et al. | |
| 7,762,323 | B2 | 7/2010 | Frazier | |
| 8,579,024 | B2 | 11/2013 | Mailand et al. | |
| 8,770,276 | B1 | 7/2014 | Nish et al. | |
| 9,359,861 | B2 | 6/2016 | Burgos | |
| 9,416,617 | B2 | 8/2016 | Wiese et al. | |
| 10,837,254 | B2 | 11/2020 | Al-Mousa et al. | |
| 2004/0040707 | A1 | 3/2004 | Dusterhoft et al. | |
| 2005/0263282 | A1 | 12/2005 | Jeffrey et al. | |
| 2006/0213656 | A1 * | 9/2006 | Clifton | E21B 33/128 166/125 |
| 2008/0314591 | A1 | 12/2008 | Hales et al. | |
| 2011/0203794 | A1 | 8/2011 | Moffitt et al. | |
| 2013/0240207 | A1 | 9/2013 | Frazier | |
| 2016/0084034 | A1 | 3/2016 | Roane et al. | |
| 2016/0281458 | A1 | 9/2016 | Greenlee | |
| 2017/0067313 | A1 | 3/2017 | Connell et al. | |
| 2018/0010418 | A1 | 1/2018 | VanLue | |
| 2018/0252069 | A1 | 9/2018 | Abdollah et al. | |
| 2019/0284898 | A1 | 9/2019 | Fagna et al. | |
| 2020/0056446 | A1 | 2/2020 | Al-Mousa et al. | |

OTHER PUBLICATIONS

PCT International Search Report and Written Opinion issued in International Application No. PCT/US2019/046510 dated Nov. 18, 2019, 17 pages.

* cited by examiner

TANDEM CEMENT RETAINER AND BRIDGE PLUG

CLAIM OF PRIORITY

This application claims priority to and is a continuation of U.S. patent application Ser. No. 16/103,447, filed on Aug. 14, 2018, the entire contents of which is hereby incorporated by reference.

TECHNICAL FIELD

This disclosure relates to a tandem cement retainer and bridge plug for remedial applications such as squeeze cementing.

BACKGROUND

Oil well cementing may include mixing a slurry of cement and water, and pumping the slurry down the wellbore casing, tubing, or drill pipe to a specified elevation or volume in the well. Primary cementing may involve casing cementation. In particular, primary cementing may be the cementing that takes place soon after the lowering of the casing into the hydrocarbon formation and may involve filling the annulus between the casing and the hydrocarbon formation with cement. Secondary cementing may include various cementing operations in which cement is pumped into a well during drilling or production phases. Secondary cementing can involve remedial cementing such as squeeze cementing.

SUMMARY

An aspect relates to a downhole tool assembly including a bridge plug and a cement retainer in tandem to be deployed into a wellbore on the same run for remedial cementing of the wellbore.

Another aspect relates a downhole tool assembly to be lowered into a wellbore on a single trip for secondary cementing. The assembly includes a re-settable cement retainer on an upper portion of the downhole tool assembly, a bridge plug on a lower portion of the downhole tool assembly, and a lower stinger coupling the re-settable cement retainer to the bridge plug. The bridge plug is coupled to the lower stinger via a shear pin.

Yet another aspect relates to a method of operating a downhole tool assembly for squeeze cementing of a wellbore having a casing. The exemplary method includes lowering, via a drill string, a lower bridge plug and an upper cement retainer coupled via a lower stinger into the wellbore on a single trip to below a wellbore zone to be squeeze cemented. The method includes setting the lower bridge plug, setting the upper cement retainer, and pressure testing to confirm isolation of a lower portion of the wellbore below the bridge plug. In some examples, the upper cement retainer is initially set against casing blank pipe below the wellbore zone to be squeezed. In addition, the method includes unsetting the upper cement retainer, repositioning the upper cement retainer to above the wellbore zone to be squeeze cemented, re-setting the upper cement retainer, introducing cement through the upper cement retainer into the wellbore zone, and allowing the cement introduced into the wellbore zone to harden. In some examples, prior to introducing the cement, the method can include pressure testing the cement retainer from annulus to confirm isolation of a upper section of the wellbore above cement retainer. Moreover, the introducing of the cement may involve pumping the cement through the upper cement retainer into the wellbore zone.

Yet another aspect relates to a method of operating a downhole tool assembly for remedial cementing, including coupling the downhole tool assembly to a lower end of a drill string via an upper stringer. The method includes lowering the downhole tool assembly in a collapsed mode into a wellbore on a single run via the drill string, the downhole tool assembly including a lower bridge plug and an upper cement retainer coupled via a lower stringer, wherein the upper cement retainer is mechanically re-settable. For example, the cement retainer is mechanically re-settable by rotating the string. See the non-limiting example of the drill string 110 in FIGS. 3B-3D. Further, the method includes setting the lower bridge plug, wherein the lower bridge plug is coupled to the lower stinger via a shear pin. In one example, the lower bridge plug is mechanically set hydraulically by dropping a ball into the drill string. See the non-limiting example of the ball 304 in FIG. 3B.

Yet another aspect relates to a method of operating a downhole tool assembly for squeeze cementing, including coupling the downhole tool assembly to a lower end of a drill string via an upper stringer, the upper stringer coupled via a first shear pin to a cement retainer of the downhole tool assembly. The method includes deploying into a wellbore via the drill string the downhole tool assembly to below a wellbore zone to be squeeze cemented, the downhole tool assembly having the cement retainer and a bridge plug coupled via a lower stringer, the bridge plug coupled to the lower stinger via a second shear pin. The method includes setting the bridge plug by dropping an activation ball to a ball seat of the bridge plug and pressuring the drill string to at least 1000 pounds per square inch gauge (psig). The method includes raising the drill string to pull up the lower stringer to shear the second shear pin to release the bridge plug from the lower stringer and the downhole tool assembly. The method includes setting the cement retainer by rotating the drill string in a first direction. In addition, the method includes pressure testing between the cement retainer as set and the bridge plug as set to confirm seal integrity and isolation of the wellbore below the bridge plug.

The details of one or more implementations are set forth in the accompanying drawings and the description below. Other features and advantages will be apparent from the description and drawings, and from the claims.

DETAILED DESCRIPTION

Figure 1:
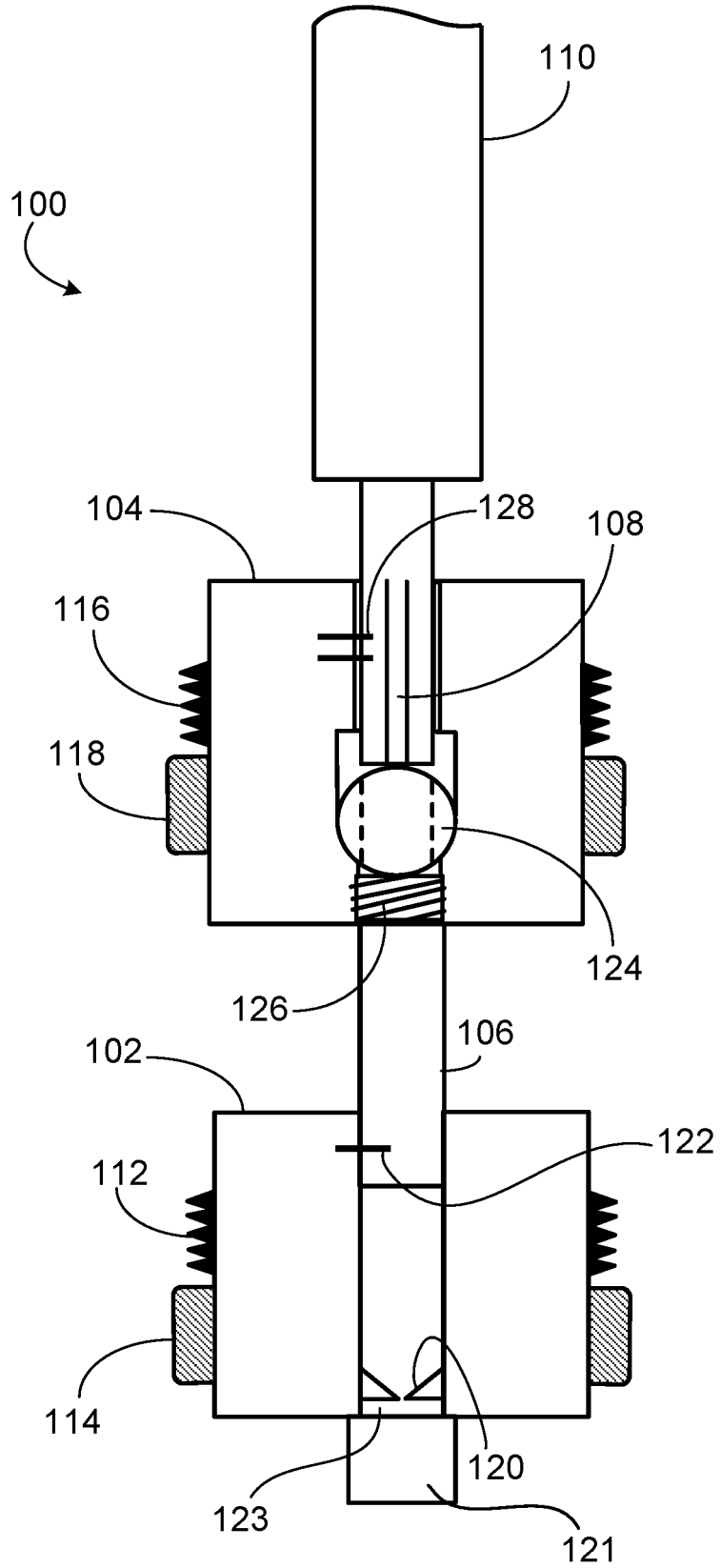
FIG. 1 is a diagram of a downhole tool assembly for secondary cementing.

Aspects of the disclosure relate to well intervention in oil and gas production. In particular, embodiments of the present techniques may be directed to well intervention equipment and methods for remedial cementing. Features may include combining both a drillable-composite bridge plug and a drillable-composite cement retainer (or squeeze packer) in tandem in one run for remedial cementing a casing leak or for selective perforation abandonment. In examples, the remedial cementing is squeeze cementing.

Squeeze cementing generally is a secondary cementing which may involve applying hydraulic pressure to force or squeeze a cement slurry or sealant in contact with a formation, either in open hole or through perforations in the casing or liner. A casing leak may be repaired by squeezing cement through the leak. Squeeze cementing is sometimes employed to seal off selectively perforations intervals, plug a water producing zone, or seal a depleted open-hole, and the like.

Again, the cement retainer may be drillable or a drillable squeeze packer in some examples. In a particular example, the composite material for the cement retainer or bridge plug body may include woven fiberglass cloth laid up with resin mixture. Some elements of the cement retainer or bridge plug may be constructed of brass or aluminum, or both.

For remedial cementing, such as squeeze cementing, a lower bridge plug and an upper cement retainer may be run downhole on two separate runs. In a first trip, the lower bridge plug may be lowered into the wellbore and set below a casing leak or perforations, and pressure tested. Then, the cement retainer is deployed on a second trip and set above the casing leak or perforations. For the remedial cementing, cement is pumped/squeezed through the cement retainer into the wellbore portion/formation zone to be isolated between the upper cement retainer and the lower bridge plug.

In contrast, embodiments herein deploy the lower bridge plug and the upper cement retainer in tandem on a single trip (the same trip). For this single-trip tandem deployment, embodiments may be a downhole drillable tool assembly employed for squeeze cementing into a casing leak or for selective perforation abandonment. The assembly may have (1) a ball-activated lower bridge plug and (2) an upper cement retainer (mechanically re-settable) deployed in tandem into the wellbore in a single trip. Such saves rig time, by eliminating one full trip as compared to the bridge plug and cement retainer deployed separately.

In operation, initially the upper cement retainer and the lower bridge plug are both deployed to below the casing leak. The lower bridge plug is set to isolate a perforation or open hole underneath from the casing leak above. Then, the re-settable upper cement retainer (or squeeze packer) is set for pressure testing. Next, the upper cement retainer may be un-set, repositioned to above the casing leak zone, and re-set. Cement is pumped through an internal flow path or bypass of the cement retainer. Lastly, the internal flow path or bypass may be closed to isolate the hydrostatic column of drilling fluid from the leak zone and to maintain the cement in position until the cement sets and hardens. Thus, certain embodiments herein include setting both a temporary, ball-activated, drillable bridge plug and a separate drillable, mechanically re-settable, cement retainer (or squeeze packer) in a single trip downhole. Again, such may save rig time and cost by eliminating one full trip compare to the two trips discussed above.

As for the tool assembly, an upper stinger may couple the cement retainer to the drill string (work string). A lower stinger may couple the cement retainer with the lower bridge plug. The lower bridge plug, once deployed, may be activated or set hydraulically, for example, by dropping a setting ball that lands on a ball seat of the bridge plug. Then, by applying pressure in the drill string, the packer elements (seal) and slips (mechanical slips) of the bridge plug may engage the wellbore casing and thus provide a seal. As mentioned, this lower bridge plug may isolate lower perforations or the open hole underneath from a casing leak above. Once this bridge plug is set, the drill string may be pulled up, for example, to shear pins connecting the bottom of the lower stinger to the bridge plug. Such may release the bridge plug from the downhole tool assembly. As indicated, both the bridge plug toward the bottom and the cement retainer toward the top may be made of composite material that are drilled with a bit or mill after completing the cement squeeze operation.

After pulling up the lower stinger above the bridge plug (for example, to a few feet above the bridge plug), the upper cement retainer (re-settable) may be set, for example, by rotating the drill string in a first direction. In examples, the first direction of rotation may be right hand, or to the right or clockwise with respect to the surface. The cement retainer may be set in order to pressure test both the lower bridge plug packers (seal) and the casing in between the lower bridge plug and upper cement retainer. The pressure test may include pressuring through the working drill string and confirming that the lower wellbore is properly isolated. Then, in some implementations, by rotating the drill string in a second direction (for instance, opposite the first direction), the upper cement retainer may be unset and the drill string pulled up to reposition the upper cement retainer above, for instance, a casing leak zone. The second direction may be left hand, or to the left or counterclockwise with respect to the surface. With the upper cement retainer positioned above the casing leak, the drill string may be rotated, for example, in the first direction to re-set the upper cement retainer. Here, after re-setting the upper cement retainer, the internal bypass or flow path of the cement retainer may be in the open position for squeeze cementing.

In some examples, confirmation of setting of the cement retainer may be by pressuring the casing-drill pipe annulus. The pressure test may confirm that the packer element of the cement retainer is sealing against the internal surface of the casing and that the casing itself above the cement retainer (FIG. 3D) has no leak. The pressure test may be based on casing condition from corrosion log interpretation. In one example, the pressure test is performed at least to 500 pound per square inch gauge (psig) with the hydrostatic head of drilling fluid (kill fluid). In another example, the pressure test is performed to 1500 psig or less with water. In some instances, the pressure test may be performed per an industry standard or company policy.

Then, after setting of the cement retainer (and any pressure testing), the drill string may be raised to apply straight pull force. Thus, the shear pins holding the cement retainer to the upper stinger or drill string may shear. The upper stinger is pulled out of the cement retainer to close, for example, an internal bypass or flow path of the cement retainer. In examples, the internal bypass has generally not been open and not closed in the preceding steps. A purpose of the raising of the stinger and closing of the internal bypass may be to verify bypass functionality of close/open and also best practice to shear the pins before starting the remedial cementing job. Once cement slurry is mixed and ready to be pumped, the upper stinger may be lowered back into the cement retainer to re-open the internal bypass and the cement squeeze operation can be performed. Again, as should be apparent, the internal bypass would have typically already been open if the stinger earlier had remained in the cement retainer but the pins would not have been sheared and the bypass closed position functionality not confirmed.

The cement is then pump from the surface through the drill string and the internal bypass in the cement retainer to the wellbore zone below to be squeeze cemented. Then, after pumping the cement slurry, the upper stinger is pulled out of the cement retainer to close the bypass and isolate the hydrostatic column of the drilling fluid from above the leak zone and maintain the cement in position until the cement sets and hardens. Lastly, as indicated for embodiments, the upper cement retainer and the lower bridge plug, and the lower stinger in between, may be made of easily drillable material that can be drilled with a conventional bit or mill.

In general, cement retainers are typically used in cement squeeze or similar remedial treatments. As discussed, a specially profiled probe known as a stinger may be attached to the bottom of the tubing string or drill string to engage the retainer during operation. When the stinger is removed, the valve assembly of the cement retainer may isolate the wellbore below the cement retainer. The cement retainer may be a tool including slips, a ported mandrel, elastomer or rubber sealing elements, and so forth. In some implementations, the cement retainer may be set in the casing which allows cement or other fluids to be pumped through the tool, but seals against fluid movement when the tubing is released from the tool. Thus, a cement retainer may be an isolation tool set in the casing or liner that facilitates treatments to be applied to a lower interval while providing isolation from the annulus above. As mentioned, a profiled probe known as a stinger is connected to the bottom of the tubing string and inserted into the cement retainer during operation. Again, when the stinger is removed, the cement-retainer internal valve assembly will close and isolate the wellbore below the cement retainer In summary, some embodiments herein include a downhole easy drillable tool assembly employed for squeeze cementing into a casing leak or for selective perforation abandonment. The assembly has (1) a ball-activated lower composite material bridge plug and (2) an upper composite material cement retainer (mechanically re-settable) deployed in tandem into the wellbore in a single trip. Such saves rig time by eliminating one full trip as compared to the bridge plug and cement retainer deployed separately. In operation, the lower bridge plug is set underneath a casing leak to isolate a perforation, open hole, or casing/liner underneath from the casing leak above. Then, the re-settable upper cement retainer is set below the casing leak for pressure testing. Next, the upper cement retainer will be unset, repositioned to above the casing leak zone, and re-set. Cement is pumped through an internal bypass of the cement retainer. Lastly, the cement stinger may be sheared and stung out from cement retainer, the internal-bypass ball valve shifting to close position under final squeeze pressure to isolate the hydrostatic column of drilling fluid from the leak zone or perforation, and to leave pressure below until the cement sets and hardens. Whereas a squeeze packer in lieu of the cement retainer may not be drillable and is pulled out to surface after the squeeze job.

Due to their composite-material construction, both the bridge plug and cement retainer may be easy drillable with a relatively low amount of junk generated in the drilling. Such may result in reduced rig time and reduced number of future runs for cleaning the junk, and the like. Junk may be relatively small items of non-drillable metals that fall or are left behind in the wellbore or borehole during the drilling.

FIG. 1 is a downhole tool assembly 100 that can be coupled to a working drill string 110 and sent downhole into a wellbore in a single trip. The assembly 100 includes a bridge plug 102 and cement retainer 104 as discrete or separate devices coupled via a lower stinger 106. The bridge plug 102 is a lower portion of the assembly 100 below the cement retainer 104. The cement retainer 104 is an upper portion of the assembly 100 above the bridge plug 102. As indicated, the bridge plug 102 and cement retainer 104 (as components of the tool assembly 100) may be lowered in tandem into the wellbore on the same run. The coupling via the lower stinger 106 may facilitate deployment of the bridge plug 102 and cement retainer 104 on the same run. The lower stinger 106 may be a profiled probe or longitudinal coupler having a specified length. In examples, the lower stinger 106 may be coupled to the cement retainer 104 via a threaded connection or other type of connection. In contrast, the lower stinger 106 may be coupled to the bridge plug 102 via a shear pin 122, as discussed below.

A bridge plug 102 may be a downhole tool that is located and set in the wellbore to isolate the lower part of the wellbore. Bridge plugs may isolate or seal the lower wellbore from production, from a treatment conducted on an upper zone, or as well control barrier for a high pressure zone underneath, and so forth. Indeed, a bridge plug may be run and set in casing to isolate a lower zone while an upper section is tested, cemented, stimulated, or produced. In general, bridge plugs in place may be permanent, retrievable, drillable, and the like. To facilitate removal by drilling, a bridge plug may be made of cast iron or composite material. In the illustrated example of FIG. 1, the bridge plug 102 is constructed of composite material and is drillable. In certain implementations, the bridge plug 102 may be a one-time set plug and isolate the wellbore section below. The bridge plug 102 may have a ball seat 120 and be set by a setting ball and pressure, and not have a close/open sleeve or ball.

A cement retainer 104 may be a sealer or isolation tool set in the casing or liner that facilitates treatments to be applied to a lower interval while providing isolation from the annulus above. The cement retainer may be a tool set temporarily or permanently in the casing or well to prevent the passage of cement, thereby forcing or routing the cement to follow another designated path. In certain embodiments discussed herein, the cement retainer 104 is ultimately set permanently and may be removed by being drilled. Again, the cement retainer 104 may be employed in squeeze cementing and other remedial cementing jobs. The cement retainer 104 generally has an internal bypass (for example, internal bypass valve 124) and hold-down slips (for example, mechanical slips 116). The bypass gives a path for cement flow through the cement retainer 104 to further downhole, and thus may be labeled as a cementing internal bypass. Indeed, the bypass can facilitate the pumping/injection of cement through the cement retainer 104 to the treatment zone, for example, having the casing leak or perforations to be cemented. Of course, the internal bypass may also allow for fluid generally, such as drilling fluid, to flow through the cement retainer. The hold-down slip assembly, such as mechanical slips 116, may facilitate application of relatively high squeeze pressure without the cement retainer 104 unsetting or moving up the wellbore. The bypass may be closed when the remedial cementing of that zone is complete.

In some examples, a squeeze packer or cement retainer 104 may be a downhole permanent or drillable cement retainer set by lowering some of the weight of the tubing string 110 onto the cement retainer 104. The weight expands the sealing element, such as seals 118, of the cement retainer 104 to prevent flow between the tubing string 110 and the casing below the cement retainer. Again, the cement retainer 104 may be a millable cement retainer for remedial cementing such as squeeze cementing. In certain implementations, the cement retainer 104 may be employed to pressure test the section above or the section below and provide a path for pumped cement through the cement retainer to below the cement retainer. The cement retainer 104 may have a mechanical set/unset by rotation of the drill string 110. In particular examples, the cement retainer 104 may have close/open positions by shifting a ball valve 124 via the stinger 108 and lock with a hexagonal profile, and so forth.

In summary, a cement retainer 104 may be drillable and for receiving pumped cement there-through, and can maintain pressure underneath while cement sets. In contrast, while a squeeze packer may be compared to a cement retainer, examples of a squeeze packer are retrievable and non-drillable, are generally not used for pumping cement there-through, and typically cannot accommodate the cement setting under pressure. Some squeeze packers can be employed to squeeze chemical treatment or acid while isolating the upper casing or wellbore from squeeze pressure The drill string 110 or the assembly 100 may include an upper stinger 108 to couple the cement retainer 104 (and thus the assembly 100) to the drill string 110. The stinger 108 may be a profiled probe attached to the bottom of the tubing string 110 to engage the cement retainer 104. In the illustrated embodiment, the upper stinger 108 has a profiled portion, such as a hexagonal portion, to lock with the cement retainer 104. In some examples, the upper stinger 108 with its hexagonal profile to apply or transmit torque via an operator rotating the string 110 for setting and un-setting the cement retainer 104.

The bridge plug 102 has mechanical slips 112 and a seal 114. The mechanical slips 112 may be wedge-shaped or other shape, and may have protrusions (for example, on the slip face) such as teeth, buttons, wickers, inserts, wedges, and the like, to engage (for example, grip) the inner wall of the casing, tubing, or liner. The mechanical slips 112 are typically radially expandable or extendable to engage (abut, grip, partially penetrate, or hook into) the inner wall of the wellbore casing to secure (lock, fix, or anchor) the bridge plug 102 in place in the wellbore. The mechanical slips 112 may longitudinally fix the bridge plug 102 in place in the wellbore. The seal 114 may be sealing elements that are packer type to prevent flow upward or downward. The seal 114 may be or include elastomer, rubber, metal, donut-shaped, seal assembly, rings, metallic rings, backup rings, lock, ratchet-lock, anchor, packing, packer seal, and so on. In operation, the seal 114 may be radially expanded against an inner surface of the casing 202 to seal the bridge plug 102 as set in place.

Similarly, the cement retainer 104 may have mechanical slips 116 and a seal 118. The mechanical slips 116, which may be the same or similar as the bridge-plug 102 mechanical slips 112, may secure or set the cement retainer 104 in place in the casing. The seal 118, which may be the same or similar as the bridge-plug 102 seal 114, may seal the set cement retainer 104 in place in the casing. Again, the bridge plug 102 and cement retainer 104 may be drillable.

The lower bridge plug 102 of the downhole tool assembly 100 may have a ball seat 120 to receive an activation ball or setting ball to activate or set the bridge plug. Indeed, examples of the bridge plug 102 are set by a setting ball. To set the bridge plug 102 may extend the mechanical slips 112 and expand the seal 114 against the inner surface of the casing wall (to grip the casing). In the illustrated example, the bridge plug 102 has the ball seat 120. In operation, a ball may be dropped from the surface through the drill string 110 and pumped down the drill string 110 and through the cement retainer 104 until the ball seats on the ball seat 120 in the bridge plug 102. Once the ball is seated on the ball seat 120, the operator can pressure the bridge plug 102 to apply pressure against the ball and ball seat. Moreover, the operator may continue to apply pressure from the surface and the pressure may beneficially act on the ball and seat 120. In some examples, below the ball seat 120 may be a pup joint 121 connected to the bottom of bridge plug (as a guide) and a gap 123.

In the illustrated embodiment of FIG. 1, the bridge plug 102 is coupled to the lower stringer 106 via one or more shear pins 122. The shear pin 122 may hold the weight of the lower bridge plug but may shear with exposed greater weight. In one example, the shear pin 122 will shear when subjected to weight of at least 30 thousand pounds (klbs).

The cement retainer 104 may include internal bypass valve 124 which may include or be a ball that rotates, or other type of valve. If a ball is employed, the ball may be a hollow ball in having a hollow portion or port including an interior-volume space as a path for cement to flow. In some examples, the ball may be a ball valve. Such a ball valve may be full-port or full-bore in certain examples. In implementations, spring loading is provided by a spring 126 for opening and closing the bypass valve 124 by pushing with the upper cement stinger 108. As indicated, the ball valve 124 may be or along the internal bypass. In some implementations, when the stinger 108 is inside the cement retainer 104, the stinger 108 pushes and rotates the ball of the bypass valve 124 to an open position and compresses down the springs 126. Such allows cement or other drilling fluids to be pumped down through the cement retainer 104 via the internal bypass. When the stinger 108 is out of the cement retainer 104, the springs 126 pushes the bypass valve 124 ball up which will rotate back to closed position to seal the internal (bypass) conduit of the cement retainer 104. Thus, once the stinger 108 is stung out (through a profile), the spring 126 may push the bypass valve 124 ball which rotates to close the cement retainer 104, isolating the upper hydrostatic column from the leak zone below the cement retainer 104. As indicated, the spring 126 is for the valve 124. While running in hole, the internal valve 124 may be in open position to allow for dropping of the setting ball (for example, 304 in FIG. 3) to pass through the cement retainer 104 to the lower bridge plug 102 and reach the ball seat 120.

The cement retainer 104 may be coupled by one or more shear pins 128 to the upper stinger 108 and thus coupled to the drill string 110. In the illustrated example, two shear pins 128 are depicted. The shear pins 128 hold the weight of the lower bridge plug 102 and the cement retainer 104. Once the upper cement retainer 104 is set, the shear pins 128 may be sheared such as by raising the drill string 110 to decouple the cement retainer 104 from the upper stinger 108. Such may un-sting the cement retainer 104 from the stinger 108, for example, to close the internal bypass valve 124. In one example, the shear pins 128 may shear at a force or weight of at least 50 klbs.

The cement retainer 104 may be set and remain in hole, and isolate the hydrostatic above during wait time on cement to harden, and with the cement stinger retrieved, and so on. Moreover, the cement retainer 104 may facilitate, for example, a hesitation squeeze such for when a primary squeeze cement has failed. Again, the cement retainer seal 118 may be sealing elements of packer type and with flow not allow upward or downward when the packer-type seal is expanded.

In summary, the cement retainer may be re-settable and with a cycling close/open ball valve 124. A purpose or function of the ball 124 cycling close/open feature may be associated with multiple sting in/out for the cement stinger 108 during the cement job. When the internal bypass or bypass valve 124 is closed, there generally is no flow through or around the cement retainer 104. As the cement job is completed or finished, the sting out from the cement retainer 104 closes the bypass valve 124 so that there will generally not be flow through (or around) the cement retainer 104, with sealing facilitated by the seals 118. In the example depiction of FIG. 1, the internal bypass valve 124 is in the open position.

Figure 1B:
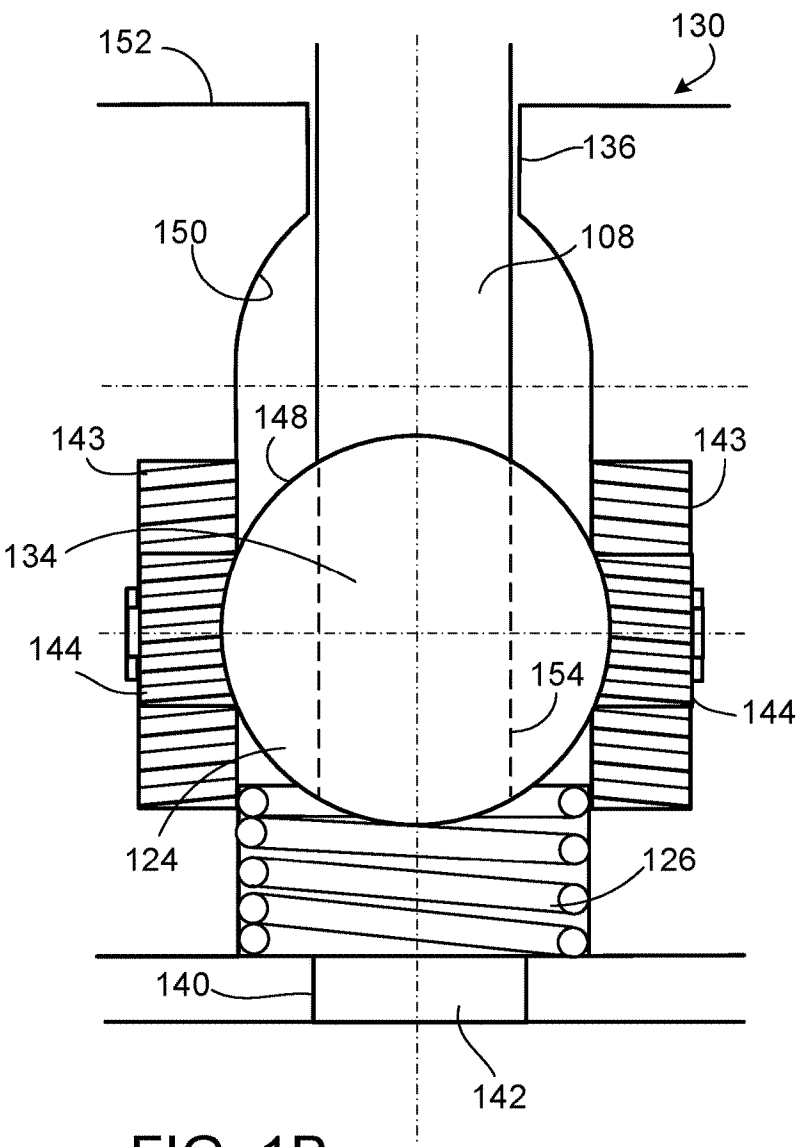
FIG. 1B is a diagram of the cement-retainer internal bypass FIG. 1A but in the open position.
Figure 1A:
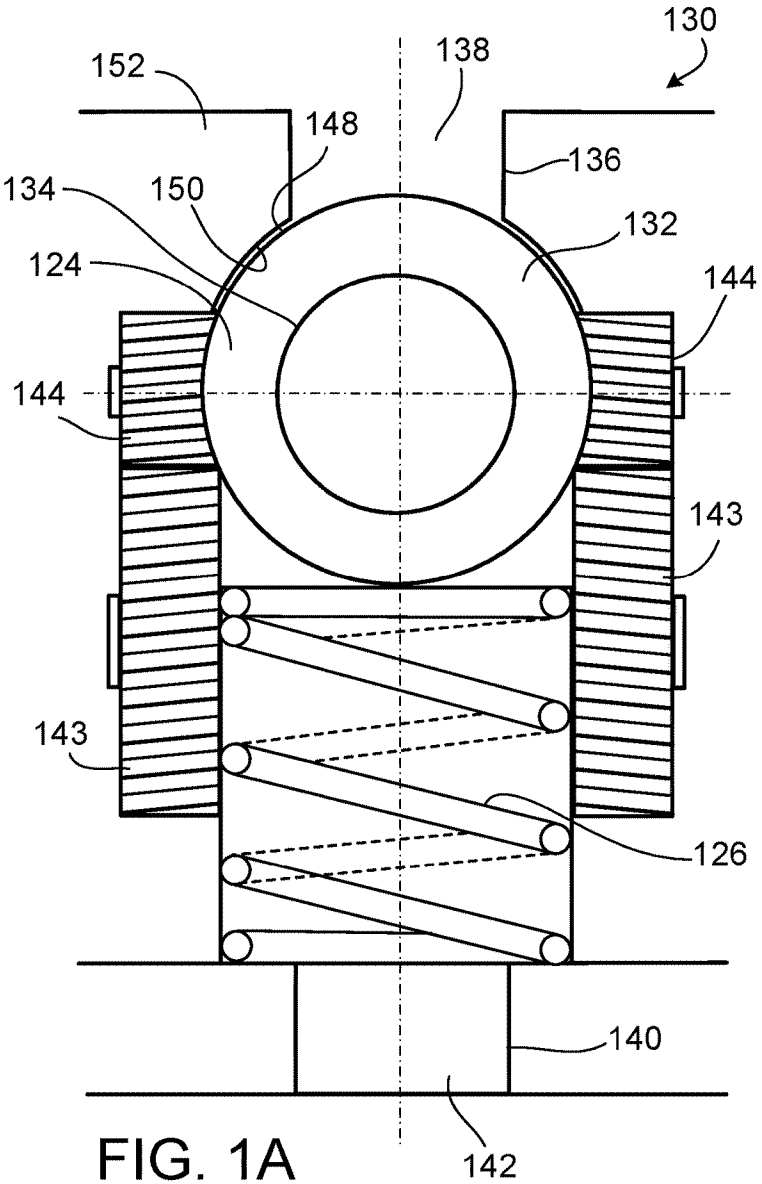
FIG. 1A is a diagram of a cement-retainer internal bypass in a closed position.

FIG. 1A is an example of the internal bypass 130 of the cement retainer 104. The internal bypass 130 has the bypass valve 124. The internal bypass 130 in an open position allows for cement slurry or fluids to flow from the drill string 110 above through the cement retainer 104 to below the cement retainer 104. If desired, drilling fluids or cement can flow through the open internal bypass 130 (and thus through the cement retainer 104) while the cement retainer 104 is being lowered into and repositioned in the wellbore, and after the cement retainer is set in the wellbore 104.

After the cement retainer 104 is set in final position, cement slurry is pumped for the squeeze cementing and flows through the internal bypass 130 to the isolation zone below the cement retainer 104. After the squeeze cementing (through the internal bypass 130) is complete, the internal bypass 130 may be placed in a closed position as depicted in FIG. 1A.

The bypass valve 124 includes a ball 132 having an opening 134 such as a hollow portion or port including giving a full-port ball valve. The opening 134 may be full port in the sense that the diameter of the opening 134 is generally the same at the inside diameter (ID) of the bypass conduit or stinger 108.

The internal bypass 130 may have a cavity or conduit 136 as an inlet 138 to receive cement from the drill string 100 and stinger 108 above. The bypass 130 may have a cavity or conduit portion 140 as an outlet 142 for discharge of cement from the cement retainer 104 to below the cement retainer 104.

The internal bypass 130 may include fixed linear gears 143 to the side that engage gears 144 coupled to the outer surface of the ball 134. Thus, the ball 132 may rotate via rotation of the ball gears 144 along the linear gears 143. The ball 132 may rest on the spring 126.

To close the bypass valve 124 and thus close the bypass 130, the upper stinger 108 may be raised to pull the stinger 108 out of the cement retainer 104. This allows the spring 126 to push up the ball 132 such that the outer diameter (OD) surface 148 of the ball 132 presses against the sealing surface 150. As the ball is 132 is pushed up by the spring 126, the ball 132 rotates to the closed position depicted in FIG. 1A. The closed position may be characterized as the opening 134 not aligned (not in-line) with the internal bypass 130 flow conduit including portions 136 and 140. For the internal bypass 130 closed position depicted in FIG. 1A, the stinger 108 is not at the inlet 138. Instead, the stinger 108 is disengaged from the cement retainer 104 to allow the spring 126 to decompress and push the ball 132 up against the sealing seat 150 and thus to rotate the ball 132 via the gears 144 to the closed position.

FIG. 1B is the example internal bypass 130 in the open position. To open the internal bypass 130, the stinger 108 is inserted into the body 152 of the cement retainer 104 to push down the ball 132 against the spring 126. The ball 132 rotates via the ball gears 144 engaged with the fixed side gears 143. The spring 126 is compressed. The ball 132 rotates such that the ball opening 134 is aligned (in-line) with the internal bypass flow conduit, as indicated by reference numeral 154. The opening 134 (hole) through the ball 132 aligns with the internal ID of the stinger 108 to pass the setting ball (see 304 of FIG. 3B) of the bridge plug and also to allow pumping cement through the cement retainer 104. Lastly, it should be emphasized that other configurations of an internal bypass may be employed. Indeed, the internal bypass depicted in FIGS. 1, 1A, and 1B is given as only an example.

Figure 2:
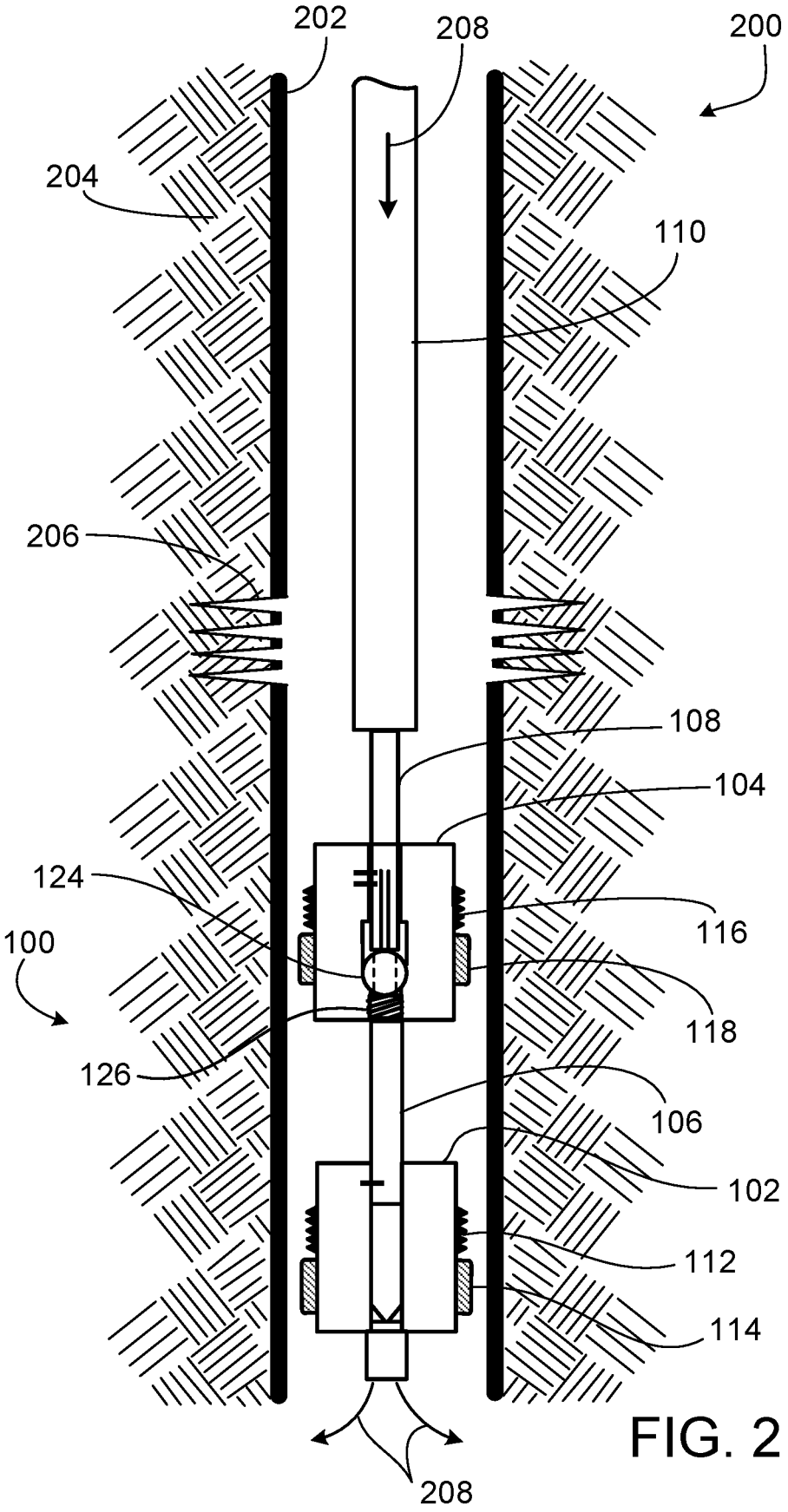
FIG. 2 is a diagram of the downhole tool assembly of FIG. 1 lowered into a wellbore.

FIG. 2 is a wellbore 200 formed with a casing 202 into an Earth subsurface formation 204. In examples, a cement layer (not shown) may be disposed in the annulus between the casing 202 and the formation 204. The wellbore 200 has perforations 206 through the casing 202 into the formation 204. The wellbore 200 may receive hydrocarbon, such as oil and gas, from the formation 204 through the perforations 206 for oil or gas production.

The downhole tool assembly 100 of FIG. 1 coupled to a drill string 110 is depicted as lowered into the wellbore 200 at a desired position in the wellbore 200. The downhole tool assembly 100 may be implemented or applied for remedial reasons such as repairing a casing 202 leak or for selective perforation abandonment, and so on. In examples of cementing a casing 202 leak, the assembly 100 may be placed downhole below the casing 202 leak. The lower bridge plug 102 and upper cement retainer 104, in collapsed mode, may be run inside the wellbore 200 to below the perforations 206 or to a depth of good casing below a casing leak. The collapsed mode is the mechanical slips 112, 116 and seals 114, 118 not radially extended or expanded. The perforations 206 may be the perforations that are to be abandoned and therefore cemented (cement flow through the drill string shown by reference numeral 208). The perforations 206 may also be cemented in repair of a casing leak.

FIGS. 3A-3E are a portion of a wellbore 300 over time. Demonstrated is the operation of the downhole tool assembly 100 for remedial cementing such as squeeze cementing. In some examples, the internal bypass valve 124 in the cement retainer 104 is open in FIGS. 3A, 3B, 3C, and 3D.

Figure 3A:
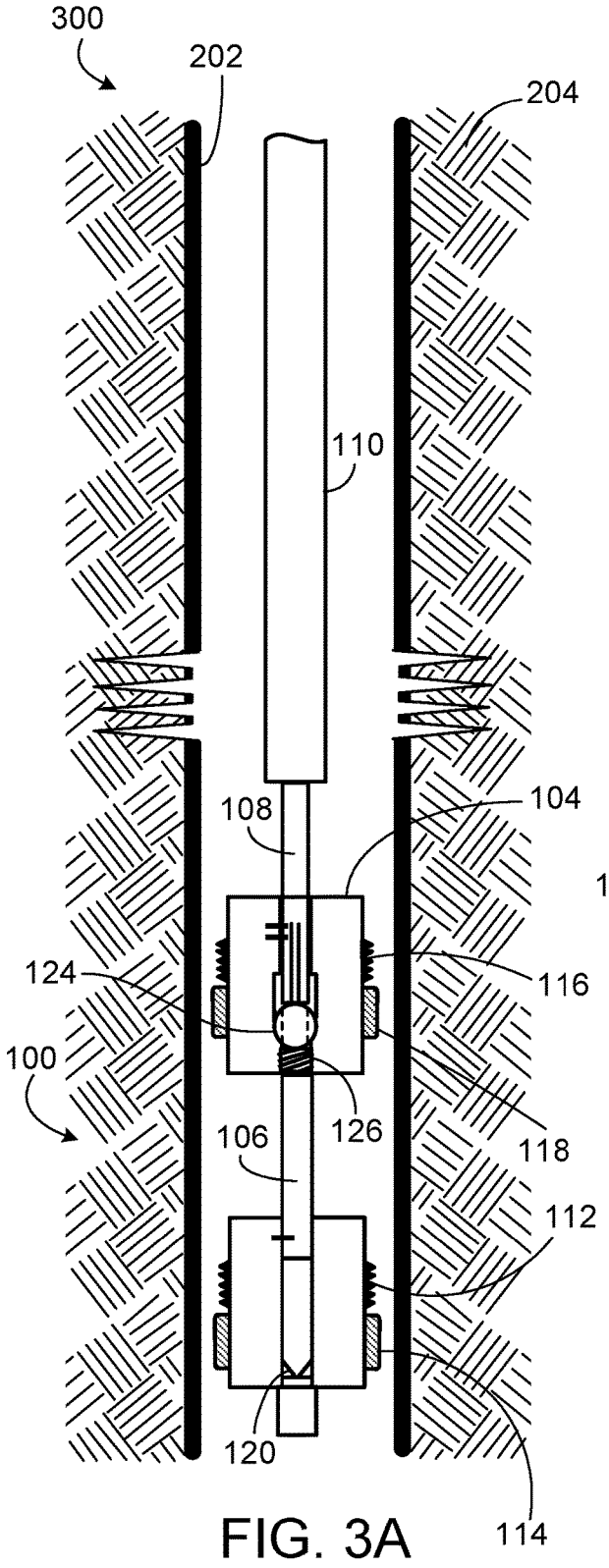
FIGS. 3A-3E are diagrams of a downhole tool assembly over time as deployed in a wellbore.

FIG. 3A may be similar to the operation depicted in FIG. 2 in which the downhole tool assembly 100 is lowered and positioned into the wellbore 300. An upper stinger 108 may couple the cement retainer 104 to the drill string 310 (work string). A lower stinger 106 may couple the cement retainer 104 with the lower bridge plug 102. Both the bridge plug 102 toward the bottom and the cement retainer 104 toward the top may be made of composite material that are drilled with a bit or mill after completing the cement squeeze operation.

In FIG. 3A, on a single trip into the wellbore 300, the lower bridge plug 102 and upper cement retainer 104 may be in collapsed mode and run to below the perforations 206 or to a depth of good casing below a casing leak. The collapsed mode may mean that the mechanical slips 112, 116 and seals 114, 118 are not radially extended or expanded. In some examples, the collapse mode may be the initial mode of the assembly 100 in deployment into the wellbore 300 for remedial cementing such as squeeze cementing.

Figure 3B:
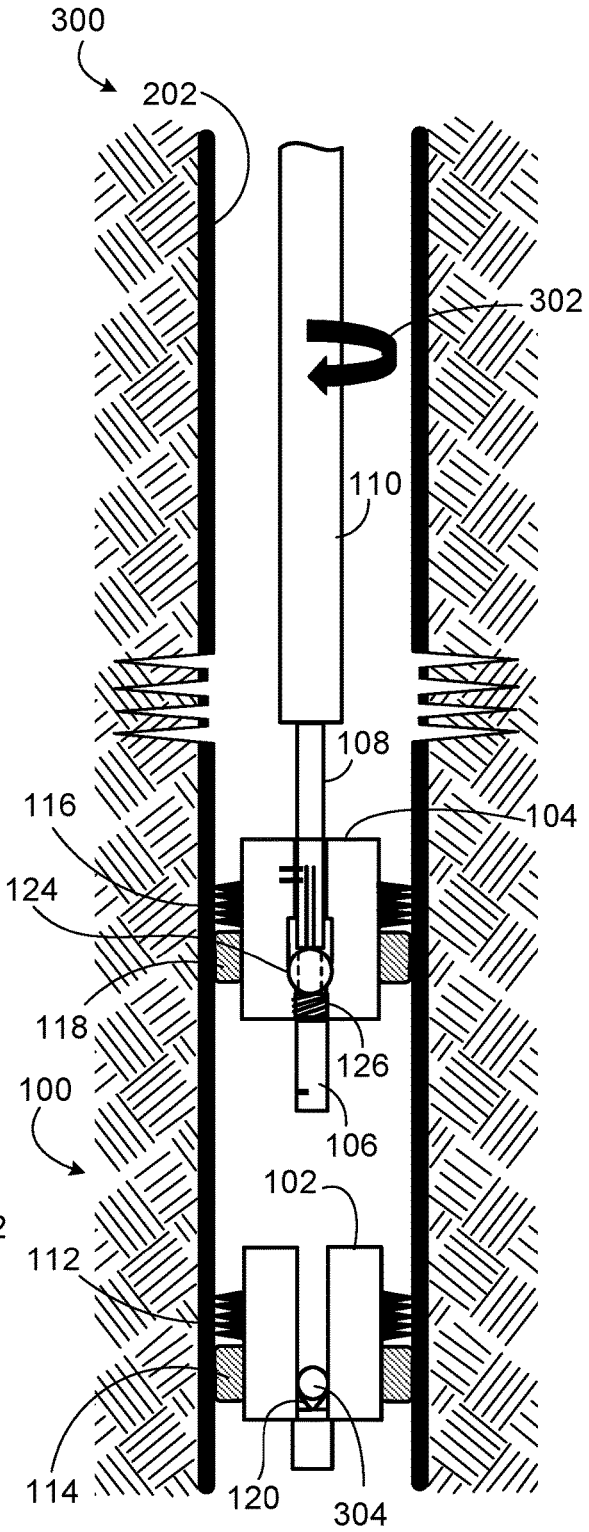

Referring to FIGS. 3A and 3B, after the downhole tool assembly 100 being deployed in the wellbore 300 including being lowered to the desired or specified vertical location or position within the wellbore 300, the lower bridge plug 102 may be set by dropping an activation ball 304 and pressuring up the string 110 such as to 1000 pounds per square inch gauge (psig) or greater. In response to receipt of the activation ball 304 on the ball seat 120 and the pressure, the lower bridge plug 102 may extend its mechanical slips 112 and seal 114 against the inner wall of the casing 202 to set the bridge plug 102. The set lower bridge plug 102 may isolate lower perforations (not shown) or the open hole underneath from a casing leak above.

At FIG. 3B, after the lower bridge plug 102 is set, the drill string 110 may be raised to pull up the lower stinger 106 to shear the pin 122 and release the stinger 106 from the set bridge plug 102. Such may release the bridge plug from the downhole tool assembly 100. The lower stinger 106 may be made of aluminum or other material for easy drillability. After pulling up the lower stinger 106 above the bridge plug 102 (for example, to a few feet above the bridge plug 102), the upper cement retainer (re-settable) may be set, for example, by rotating the drill string 110 in a first direction 302. In a particular example, the first direction 302 is a right hand rotation.

Continuing at FIG. 3B, with an example right-hand rotation 302 of the drill string 110, the upper re-settable cement retainer 104 is set against the casing 202 to facilitate a pressure test. The drill string 110 rotation may extend the mechanical slips 116 and seal 118 of the upper cement retainer 104 against the inner wall of the casing 202 to set the cement retainer 104. With the cement retainer 104 set, a pressure test may be to pressure test of the lower bridge plug 102 from the top, the upper cement retainer 104 from the bottom, and the casing 202 in between in order to confirm seal integrity and bottom-hole isolation. Thus, the pressure test may include pressuring through the working drill string 310 and confirming that the lower wellbore is properly isolated.

Figure 3C:
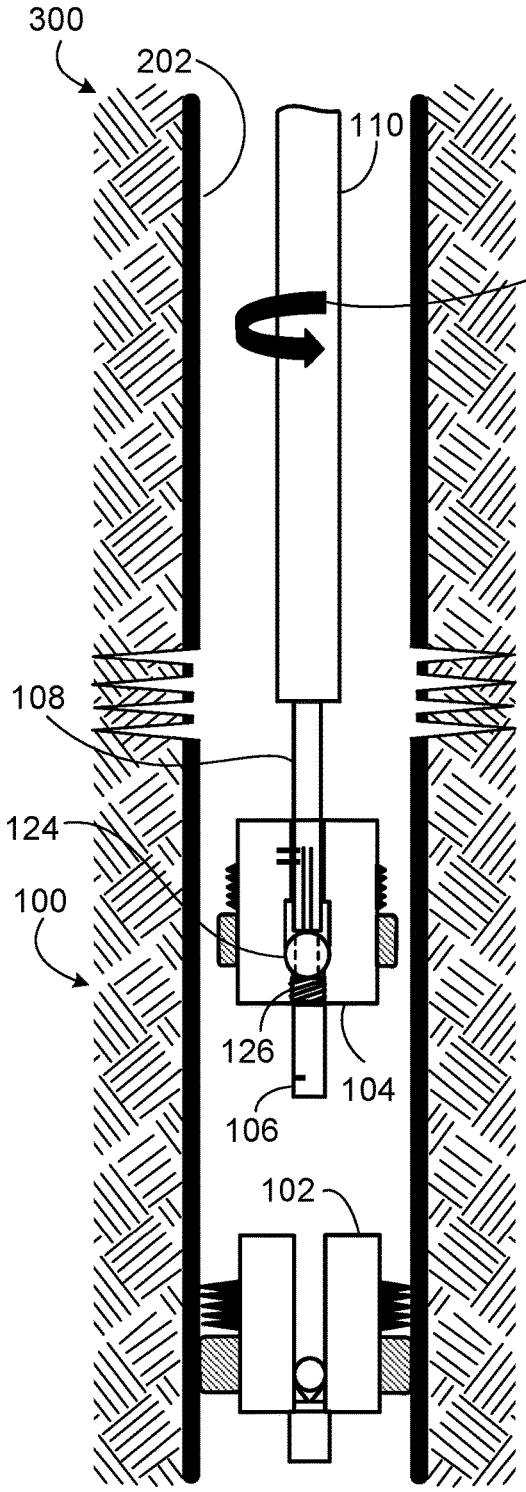

At FIG. 3C, in some implementations, by rotating the drill string 110 in a second direction 306 (for instance, opposite the first direction 302), the upper cement retainer may be unset and the drill string pulled up (FIG. 3D) to reposition the upper cement retainer above, for instance, a casing leak zone. In the illustrated example, by left hand rotation 306 (FIG. 3C) of the drill string 110, the upper, re-settable cement retainer 104 is unset (FIG. 3C) and the string 110 can be pulled to reposition (FIG. 3D) the upper cement retainer 104 above the casing leak.

Figure 3D:
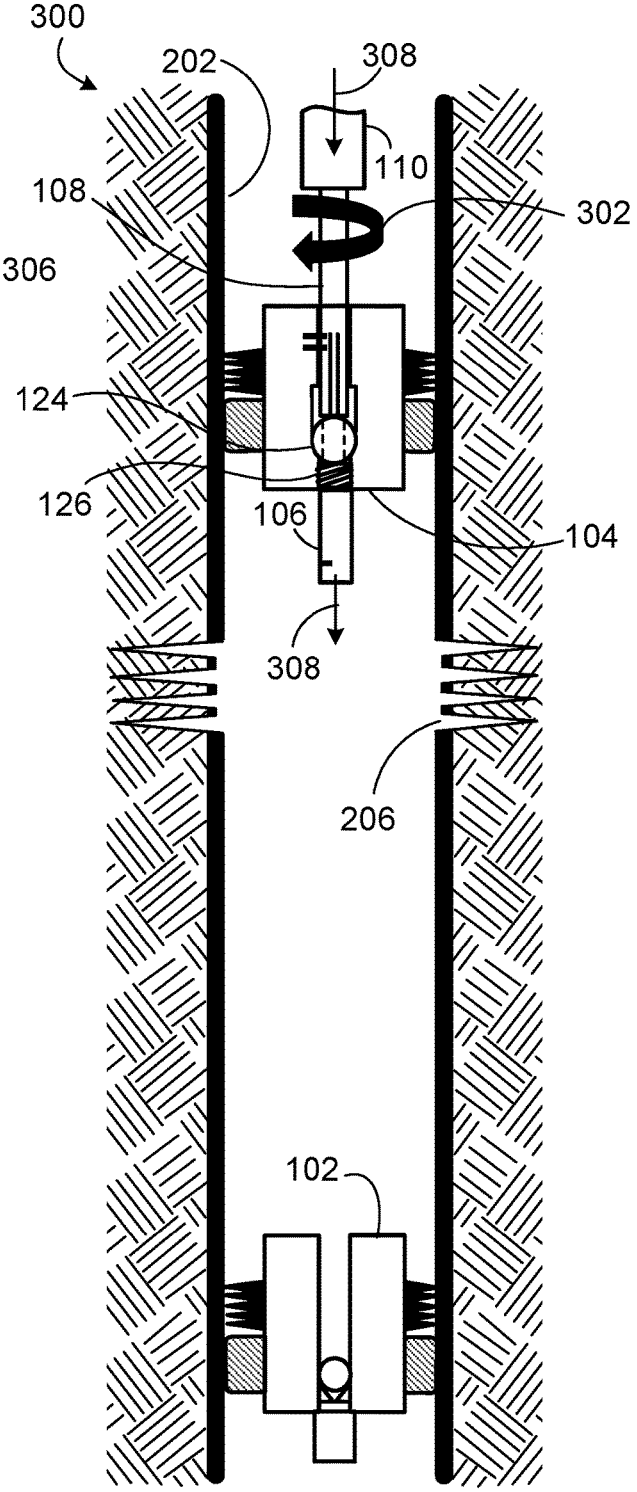

At FIG. 3D, the drill string 110 is so raised to reposition the cement retainer 104 above the casing leak or above the perforations 206 for cementing of casing leak or the perforations 206. In instances with no casing leak, the perforations 206 may be cemented for selective perforation abandonment. The flow path for the cement slurry is indicated by arrows 308.

By rotation in the first direction 302 (for example, right hand rotation) of the drill string 110, the upper, re-settable cement retainer 104 is set to seal against the casing 202 and can be pressure tested by pressuring up the casing-drill pipe annulus. Indeed, in implementations, confirmation of setting of the cement retainer 104 may be achieved by pressuring the annulus between the drill string 110 (drill pipe) and the casing 202. In examples of the pressure test, the cement retainer 104 is set above the perforations or leak zone to be cemented and without communication below the annulus during the pressure test. If the pressure test fails, such may mean that the seals 118 are not holding pressure and, therefore, the cement retainer 104 may need to be pulled out of the wellbore and replaced with a new cement retainer 104.

Figure 3E:
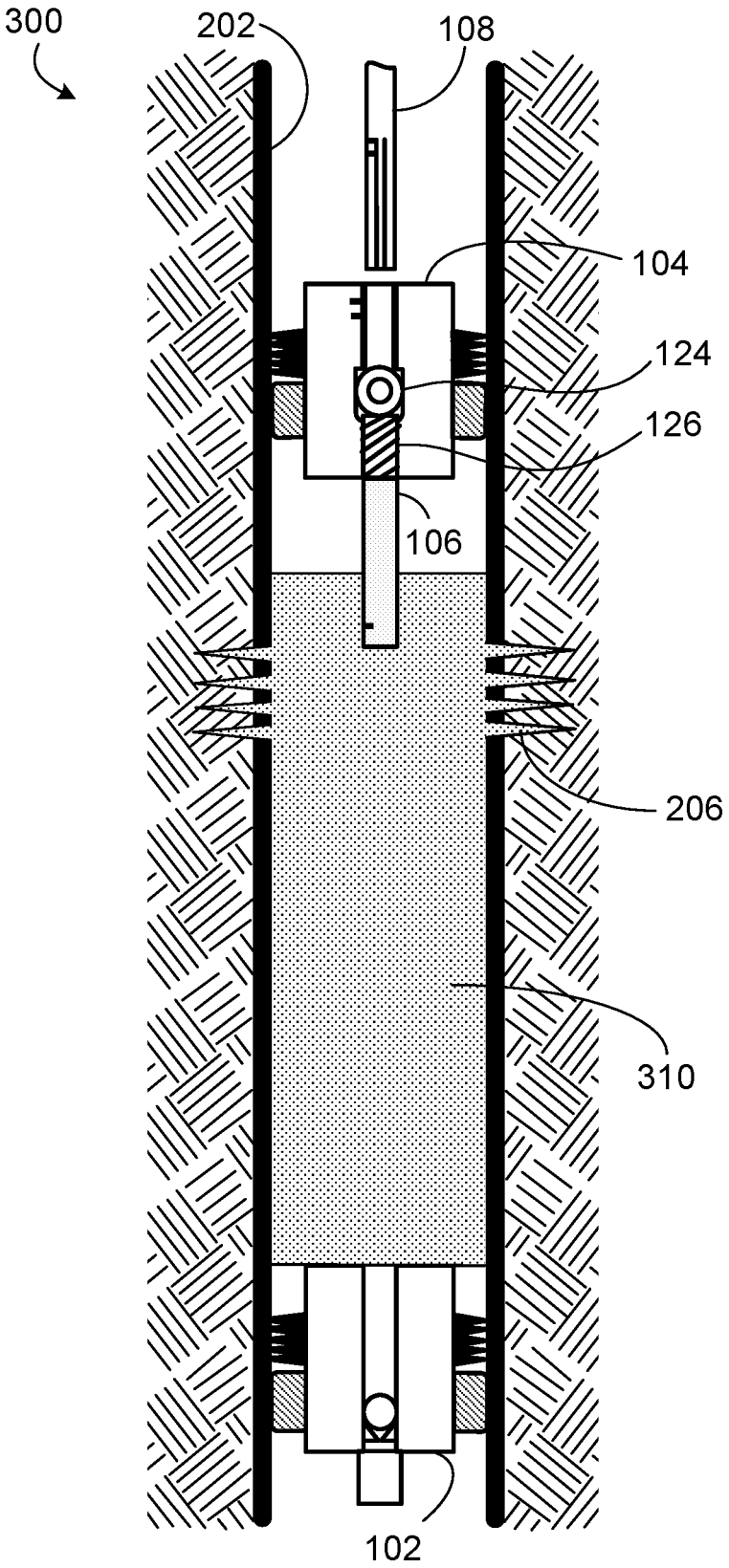

Then at FIGS. 3D-3E, by applying straight pull force via raising of the drill string 110, the shear pins 128 holding the cement retainer to the upper stinger 108 or drill string 110 may shear and the upper stinger 108 pulled out of the cement retainer 104 to close, for example, an internal bypass of the cement retainer 104. The upper stinger 108 having a hexagonal bottom end for rotational lock and torque transfer to the setting mechanism or setter of the re-settable cement retainer 104, is pulled to shear the pins 128 and release the stinger 108 from the upper cement retainer 104.

The release of the stinger 108 from the cement retainer 104 moves up the internal bypass mandrel of the cement retainer 104 to close the cementing internal bypass of the cement retainer 104. In one example, the release of the stinger 128 allows the spring 126 to push the ball of the bypass valve 124 up and thus with the ball rotating to close the valve 124.

Continuing at FIG. 3E, once cement 310 slurry is mixed and ready to be pumped, the upper stinger 108 may be lowered back into the cement retainer 104 to push the mandrel and open the internal cementing bypass channel for the cement flow. In one example, the lowered stinger 108 as being inserted pushes the ball (of the valve 124) back down rotating the ball to open the internal bypass valve 124. With the internal bypass open, the cement squeeze operation can be performed. Once the cement squeeze operation is completed, the stinger 108 is pulled out to close the internal bypass channel and isolate the hydrostatic column of the drilling fluid from the casing 202 leak zone to maintain the cement 310 in place until the cement 310 sets and hardens.

Lastly, in examples, the upper cement retainer 104, lower bridge plug 102, and lower stinger 106 in between may be constructed of drillable material and can be drilled with a conventional bit or mill. The technique may include drilling the upper cement retainer 104, the hardened cement 310, and the lower bridge plug 102.

Figure 4:
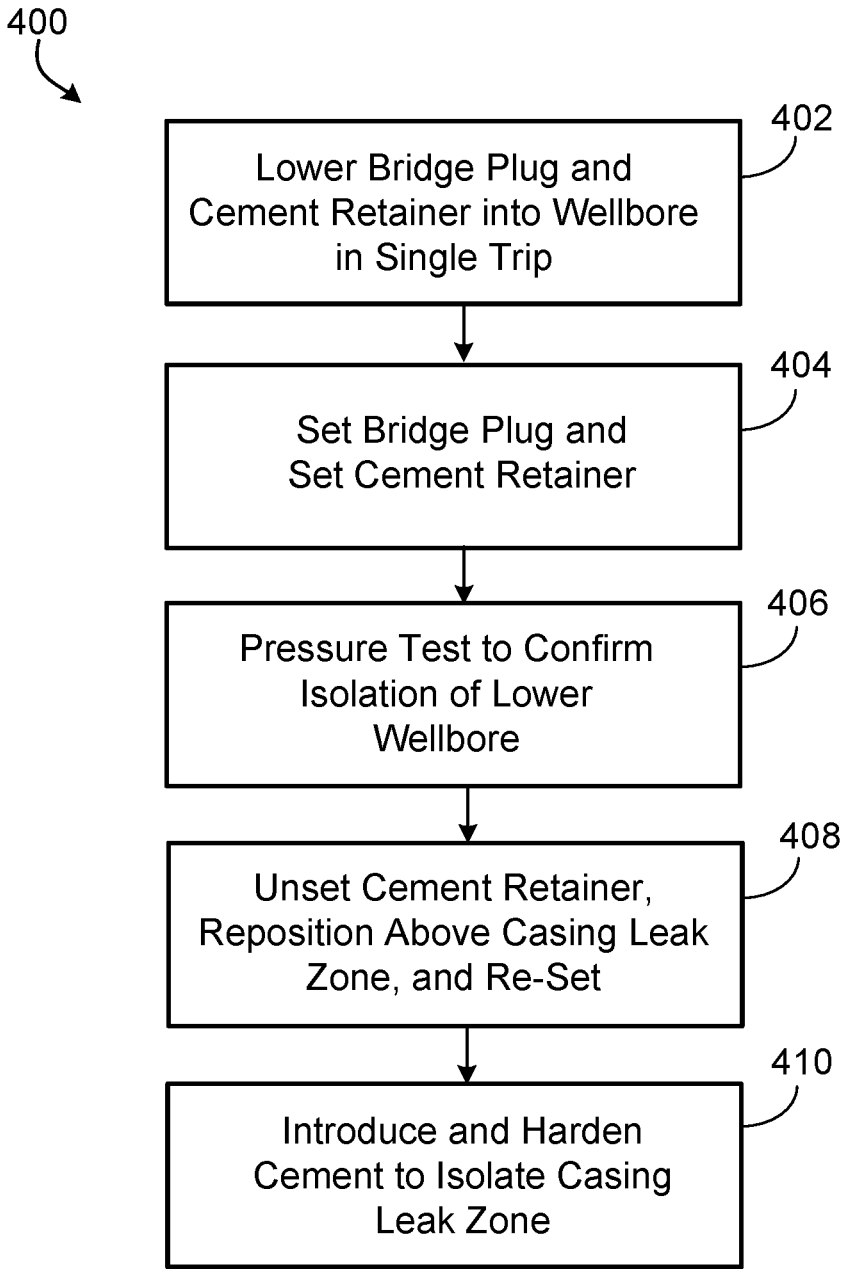
FIG. 4 is a block flow diagram of a method of operating a downhole tool assembly for secondary cementing.

FIG. 4 is a method 400 of remedial cementing of a wellbore. In particular, the method 400 may be a method of operating a downhole tool assembly for squeeze cementing of a wellbore having a casing.

At block 402, the method includes lowering, via a drill string, a lower bridge plug and an upper cement retainer coupled via a lower stinger into the wellbore on a single trip to below a wellbore zone to be squeeze cemented. In other words, a bridge plug and cement retainer as two discrete devices are lower into the wellbore in a single run or single trip. As indicated, the bridge plug and the cement retainer may be coupled via a stinger (lower stinger). In implementations, the bridge plug and the cement retainer (and stinger) may be components of the downhole tool assembly deployed. As discussed above, the downhole tool assembly may deployed initially in collapse mode.

At block 404, the method includes setting the lower bridge plug and setting the upper cement retainer. Setting the lower bridge plug may include dropping an activation ball through the drill string and the upper cement retainer to a ball seat of the lower bridge plug and pressuring the drill string. Setting the upper cement retainer may include raising the drill string to pull up the lower stringer to shear a shear pin to release the lower bridge plug, and rotating the drill string in a first direction.

At block 406, the method includes pressure testing to confirm isolation of the lower portion of the wellbore (the lower wellbore). The pressure testing may include introducing pressure through the drill string (see, for example, FIG. 3B) to pressure test the upper cement retainer from below, the lower bridge plug from above, and the casing between the upper cement retainer and the lower bridge plug. The fluid to pressure may include existing fluid from the well such as water, kill fluid, brine, drilling mud, and so on.

At block 408, the method includes unsetting the upper cement retainer, further raising the drill string to reposition the upper cement retainer above the wellbore zone to be squeeze cemented, and re-setting the upper cement retainer. In examples, unsetting the upper cement retainer is performed by rotating the drill string in a second direction opposite the first direction. The re-setting of the cement retainer may be by rotating the drill string in the first direction.

At block 410, the method includes introducing cement through the upper cement retainer into the wellbore zone, and allowing the cement introduced into the wellbore zone to harden. The cement introduced may be a cement slurry of cement and water. The method 400 may include drilling the upper cement retainer, drilling the cement hardened in the wellbore zone, and drilling the lower bridge plug.

In general, a cement retainer as a squeeze tool or squeeze packer in examples may be a type of retrievable or drillable packer in remedial cementing such as squeeze cementing. Depending on the configuration or type of cement retainer, the cement retainer may be un-settable or not un-settable. Squeeze cementing may include packer techniques, hesitation squeeze techniques, and so on. The wellbore interval to be squeezed may be isolated from the surface by a cement retainer or packer run set on tubing. Retrievable or permanent (drillable) cement retainers can be used. Further, to isolate the section below the perforations or casing leak to be squeezed, a drillable or retrievable bridge plug may be placed below the perforations or casing. The upper perforations may then be squeezed and the remaining slurry reversed out in some examples. A hesitation squeeze may involve placement of cement in a single stage but divides the placement, for example, into alternate pumping and waiting periods. This hesitation practice may utilize controlled fluid loss properties of the slurry to build filter cake nodes against the formation and inside the perforations while the parent slurry remains in a fluid state in the casing.

Equipment commonly employed in squeeze cementing includes high pressure pumps, retrievable or drillable type cement retainers (or squeeze packers) and retrievable or drillable bridge plugs, and so forth. In general, bridge plugs may provide a pressure and fluid boundary between sections of casing or can be used as well control barrier, and the like. Multiple zones can be isolated individually for the desired treating or testing procedures. Cement retainers may provide pressure or fluid control for remedial cementing operations. The cement retainer or squeeze packer tool may be used in conjunction with the work string tubular. Typically, as discussed, a valve built in the cement retainer tool helps hold cement in place by providing downhole pressure control. The cement retainer may have additional control features. Moreover, the cement retainer may be drillable or may be removed from the well by the use of common oil well drilling equipment and practices.

The cement retainer may seal off the annulus but allows fluid communication between drill pipe and the wellbore beneath the cement retainer. This type of packer contains a back pressure valve (for example, versions of a bypass valve 124) which will prevent the cement flowing back after the squeeze. These may be employed for remedial work on primary cement jobs, or to close off water producing zones. The packer may be run on drill pipe or wireline and set above or between sets of perforations. When the cement has been squeezed, the drill pipe can be removed closing the back pressure valve. The advantages of these packers may be depth control, the back pressure valve prevents cement back flowing, and the drill pipe recovered without disturbing the cement. As indicated for examples, the cement retainer may be unset and re-settable, such that the cement retainer can be utilized more than once. These generally can be set and released many times on one trip, such as with repairing a series of casing leaks or selectively squeezing off sets of perforations. In certain implementations, bypass ports (for example, with valve 124) in the packer or cement retainer may allow annular communication but these ports are typically closed during the squeeze job. When the packer or cement retainer is released there may be some backflow and the cement filter cake disturbed. In response, the packer or cement retainer may be re-set and the squeeze pressure applied until the cement sets.

Some examples of cement squeezing with a retrievable or drillable cement retainer involve running the cement retainer on a drill pipe and setting the cement retainer at the desired depth with bypass open. Cement slurry is pumped and with back pressure on the annulus to prevent cement falling. The setting depth of the cement retainer may be specified so not to be positioned too high above the perforations. In examples, the cement retainer may be set in a range of 30 feet to 50 feet above the perforations to be cemented. In a particular example, a tail pipe is employed below the cement retainer or packer to facilitate that only cement is squeezed into the perforations. Bridge plugs are often set in the wellbore to isolate zones which are not to be treated. The bridge plug may seal off the entire wellbore, and hold pressure from above and below. As mentioned, bridge plugs can be drillable or retrievable.

A downhole tool assembly for remedial cementing, such as squeeze cementing, may include two components in tandem that are lowered in a single trip via a drill string into the wellbore. The two components may be coupled via a stinger. The two components may each be a wellbore obstructer, wellbore isolator, or wellbore sealer, or any combinations thereof. The lower component may be a packer, plug, or bridge plug, and the like, in a lower position on the assembly. The upper component may be a packer, cement packer, cement retainer, or squeeze packer, and so on. The assembly can be conveyed or deployed by a drilling rig. The assembly may be connected to the drilling rig via the drill string, tubing string, or threaded pipe, and so forth. In some examples, the tandem assembly is not set on coil tubing or wireline due to no rotation feature for setting the upper cement retainer. In the illustrated example of FIG. 1, the lower component is a bridge plug 102 on a lower portion of the downhole tool assembly 100, and the upper component is a cement retainer 104 on an upper portion of the downhole tool assembly 100. Lastly, while the discussion herein at times has focused on remedial cementing, some implementations of the present techniques are applicable to other types of cementing.

In summary, an embodiment is a downhole tool assembly having a bridge plug and a cement retainer (for example, re-settable) to be deployed into a wellbore on a same run for remedial cementing of the wellbore. The cement retainer may be on an upper portion of the downhole tool assembly, and the bridge plug is below the cement retainer on a lower portion of the downhole tool assembly. In certain examples, the cement retainer and the bridge plug are coupled via a stinger to facilitate lowering of the cement retainer and the bridge plug on the same run into the wellbore. In a particular example, the cement retainer is coupled to the stinger via a threaded connection. The bridge plug may be coupled to the stinger via a shear pin. The downhole tool assembly to couple via a first stinger to the drill string, and wherein the cement retainer and the bridge plug are coupled via a second stinger to facilitate lowering of the cement retainer and the bridge plug on the same run via the drill string into the wellbore. Further, the cement retainer and the bridge plug may be each be composite material and are drillable. In some implementations, the downhole tool assembly to couple via a stinger to a drill string, and wherein the cement retainer is set via rotation of the drill string. In certain examples, the bridge plug has a ball seat to receive an activation ball to set the bridge plug against an inner wall of the wellbore. The cement retainer may have an internal bypass having a first operating position that opens squeeze cementing flow and a second operating position that closes squeeze cementing flow.

Another embodiment includes a downhole tool assembly to be lowered into a wellbore on a single trip for secondary cementing. The assembly includes a re-settable cement retainer on an upper portion of the downhole tool assembly, a bridge plug on a lower portion of the downhole tool assembly, and a lower stinger coupling the re-settable cement retainer to the bridge plug. The bridge plug is coupled to the lower stinger via a shear pin. In examples, the downhole tool assembly to couple via an upper stinger to a drill string, wherein the re-settable cement retainer is settable via rotation of the drill string and the upper stringer, and wherein the re-settable cement retainer and the bridge plug each are composite material and are drillable. In some implementations, the bridge plug has a ball seat to receive a ball dropped through the drill string to set the bridge plug. In certain examples, the re-settable cement retainer has an internal bypass having a first operating position that opens the re-settable cement retainer to squeeze cementing flow and a second operating position that closes the re-settable cement retainer to squeeze cementing flow.

Yet another embodiment includes a method of operating a downhole tool assembly for remedial cementing, including coupling the downhole tool assembly to a lower end of a drill string via an upper stringer. The method includes lowering the downhole tool assembly in a collapsed mode into a wellbore on a single run via the drill string. The downhole tool assembly has a lower bridge plug and a re-settable upper cement retainer via a lower stringer. In a particular example, the lower stringer is aluminum and drillable. The collapsed mode may be a mechanical slip of the upper cement retainer not radially extended, a seal of the upper cement retainer not radially extended, a mechanical slip of the lower bridge plug not radially extended, and a seal of the lower bridge plug not radially extended. The lowering of the assembly may be lowering the downhole tool assembly to below a zone in the wellbore to be squeeze cemented. The lowering of the assembly may be lowering the downhole tool assembly to below wellbore perforations to be cemented or to below a casing leak to be repaired via remedial cementing.

The method includes setting the lower bridge plug, wherein the lower bridge plug is coupled to the lower stinger via a shear pin. The setting of the lower bridge plug may include dropping a setting ball through the drill string and the upper cement retainer to a ball seat of the lower bridge plug and pressuring the drill string (for example, to at least 1000 psig) to set the lower bridge plug.

The method may then include raising the drill string to pull up the lower stringer to shear the shear pin to release the lower bridge plug from the lower stringer and the downhole tool assembly, rotating the drill string in a first direction to set the upper cement retainer against a casing of the wellbore, and performing pressure testing to confirm seal integrity and bottom-hole isolation. The seal integrity evaluated may include seal integrity of the upper cement retainer and the lower bridge plug. The pressure testing may include pressure testing the upper cement retainer from below, the lower bridge plug from above, and the casing between the upper cement retainer and the lower bridge plug The method may further include rotating the drill string in a second direction different than the first direction to unset the upper cement retainer, raising the drill string to reposition the upper cement retainer above a zone of the wellbore to be squeeze cemented, and rotating the drill string in the first direction to re-set the upper cement retainer to seal against the casing. The method may then involve pressure testing by pressuring an annulus between the drill string and the casing. Lastly, the method may include raising the drill pipe to pull the upper stinger to shear pins coupling the upper stinger to the upper cement retainer to release the upper cement retainer from the upper stinger and the drill string to close a cementing internal bypass of the upper cement retainer, lowering the drill pipe to lower the upper stinger back into the upper cement retainer to open the cementing internal bypass, and pumping cement through the cementing internal bypass of the upper cement retainer to squeeze cement the zone, and raising the drill string to pull the upper stinger from the upper cement retainer to close the cementing bypass.

Yet another embodiment is a method of operating a downhole tool assembly for remedial cementing, including coupling the downhole tool assembly to a lower end of a drill string via an upper stringer. The method includes lowering the downhole tool assembly in a collapsed mode into a wellbore on a single run via the drill string, the downhole tool assembly including a lower bridge plug and an upper cement retainer coupled via a lower stringer, wherein the upper cement retainer is re-settable. In examples, the lower stinger is aluminum and drillable. Further, the method includes setting the lower bridge plug, wherein the lower bridge plug is coupled to the lower stinger via a shear pin. The lowering may include lowering the downhole tool assembly to below a zone in the wellbore to be squeeze cemented. Indeed, the lowering may include lowering the downhole tool assembly to below wellbore perforations to be cemented or to below a casing leak to be repaired via remedial cementing. The collapsed mode may involve a mechanical slip of the upper cement retainer not radially extended, a seal of the upper cement retainer not radially extended, a mechanical slip of the lower bridge plug not radially extended, and a seal of the lower bridge plug not radially extended. The setting of the lower bridge plug may be by dropping a setting ball through the drill string and the upper cement retainer to a ball seat of the lower bridge plug and pressuring the drill string (for example, to at least 1000 psig) to set the lower bridge plug.

The method may include raising the drill string to pull up the lower stringer to shear the shear pin to release the lower bridge plug from the lower stringer and the downhole tool assembly, rotating the drill string in a first direction to set the upper cement retainer against a casing of the wellbore, and performing pressure testing to confirm seal integrity and bottom-hole isolation. The seal integrity may include the seal integrity of the upper cement retainer and the lower bridge plug. The pressure testing may include pressure testing the upper cement retainer from below, the lower bridge plug from above, and the casing between the upper cement retainer and the lower bridge plug.

In addition, the method may include rotating the drill string in a second direction different than the first direction to unset the upper cement retainer, raising the drill string to reposition the upper cement retainer above a zone of the wellbore to be squeeze cemented, and rotating the drill string in the first direction to re-set the upper cement retainer to seal against the casing. The pressure testing may be by pressuring an annulus between the drill string and the casing.

Furthermore, the method may include raising the drill pipe to pull the upper stinger to shear pins coupling the upper stinger to the upper cement retainer to release the upper cement retainer from the upper stinger and the drill string to close a cementing internal bypass of the upper cement retainer. The method may also include lowering the drill pipe to lower the upper stinger back into the upper cement retainer to open the cementing internal bypass, pumping cement through the cementing internal bypass of the upper cement retainer to squeeze cement the zone, and raising the drill string to pull the upper stinger from the upper cement retainer to close the cementing bypass.

Yet another embodiment is a method of operating a downhole tool assembly for squeeze cementing, including coupling the downhole tool assembly to a lower end of a drill string via an upper stringer, the upper stringer coupled via a first shear pin to a cement retainer of the downhole tool assembly. The method includes deploying into a wellbore via the drill string the downhole tool assembly to below a wellbore zone to be squeeze cemented, the downhole tool assembly having the cement retainer and a bridge plug coupled via a lower stringer, the bridge plug coupled to the lower stinger via a second shear pin. The method includes setting the bridge plug by dropping an activation ball to a ball seat of the bridge plug and pressuring the drill string to at least 1000 pounds per square inch gauge (psig). The method includes raising the drill string to pull up the lower stringer to shear the second shear pin to release the bridge plug from the lower stringer and the downhole tool assembly. The method includes setting the cement retainer by rotating the drill string in a first direction. In addition, the method includes pressure testing between the cement retainer as set and the bridge plug as set to confirm seal integrity and isolation of the wellbore below the bridge plug. The cement retainer may be re-settable.

The deploying may include deploying the downhole tool assembly on a single run including lowering the bridge plug and the cement retainer in tandem into the wellbore as components of the downhole tool assembly on the single run. The method may include: unsetting the cement retainer by rotating the drill string in a second direction; raising the drill string to reposition the cement retainer above the wellbore zone; re-setting the cement retainer by rotating the drill string in the first direction; pressure testing by applying pressure to an annulus between the drill pipe and the casing; raising the drill pipe to pull the upper stinger to shear the first shear pin to release the cement retainer from the upper stinger and the drill pipe and to close a cementing bypass of the cement retainer; lowering the drill pipe to lower the upper stinger back into the cement retainer to open the cementing bypass; pumping cement through the cementing bypass to squeeze cement the wellbore zone; and raising the drill string to pull the upper stinger from the cement retainer to close the cementing bypass. In examples, the first shear pin is multiple shear pins.

A number of implementations have been described. Nevertheless, it will be understood that various modifications may be made without departing from the spirit and scope of the disclosure.

What is claimed is:

1. A downhole tool assembly comprising:

a bridge plug; and a cement retainer to be deployed into a wellbore on a same run as the bridge plug for remedial cementing of the wellbore, wherein the cement retainer is configured to couple to a drill string, wherein the cement retainer is configured to be set by a rotation of the drill string in a first direction, unset by the rotation of the drill string in a second direction opposite the first, and re-set by the rotation of the drill string in the first direction, and wherein the cement retainer and the bridge plug each comprise composite material and are drillable.

2. The downhole tool assembly of claim 1, wherein the cement retainer is on an upper portion of the downhole tool assembly, and wherein the bridge plug is below the cement retainer on a lower portion of the downhole tool assembly.

3. The downhole tool assembly of claim 1, wherein the cement retainer and the bridge plug are coupled via a stinger to facilitate lowering of the cement retainer and the bridge plug on the same run into the wellbore.

4. The downhole tool assembly of claim 3, wherein the cement retainer is coupled to the stinger via a shear pin and the bridge plug is coupled to the stinger via another shear pin.

5. The downhole tool assembly of claim 1, wherein the downhole tool assembly is configured to couple via a stinger to the drill string, and wherein the cement retainer is set via rotation of the drill string.

6. The downhole tool assembly of claim 1, wherein the bridge plug comprises a ball seat to receive an activation ball to set the bridge plug against an inner wall of the wellbore.

7. The downhole tool assembly of claim 1, wherein the downhole tool assembly is configured to couple via a first stinger to a drill string, and wherein the cement retainer and the bridge plug are coupled via a second stinger to facilitate lowering of the cement retainer and the bridge plug on the same run via the drill string into the wellbore.

8. An assembly for secondary cementing, comprising:

a downhole tool assembly to be lowered into a wellbore on a single trip, the downhole tool assembly comprising:

a drillable re-settable cement retainer on an upper portion of the downhole tool assembly, the re-settable cement retainer comprising composite material and configured to couple to a drill string, the re-settable cement retainer configured to be set by a rotation of the drill string in a first direction, unset by the rotation of the drill string in a second direction opposite the first, and re-set by a rotation of the drill string in the first direction;

a drillable bridge plug on a lower portion of the downhole tool assembly and comprising a composite material; and a lower stinger coupling the re-settable cement retainer to the bridge plug, the bridge plug coupled to the lower stinger via a shear pin.

9. The assembly of claim 8, wherein the bridge plug comprises a ball seat to receive a ball dropped through the drill string to set the bridge plug.

10. The assembly of claim 8, wherein the re-settable cement retainer comprises an internal bypass having a first operating position that opens the re-settable cement retainer to squeeze cementing flow and a second operating position that closes the re-settable cement retainer to squeeze cementing flow.

11. A method of operating a downhole tool assembly for squeeze cementing of a wellbore having a casing, comprising:

lowering, via a drill string, a lower bridge plug and an upper cement retainer coupled via a lower stinger into the wellbore on a single trip to below a wellbore zone to be squeeze cemented;

setting the lower bridge plug and setting the upper cement retainer;

pressure testing to confirm isolation of a lower portion of the wellbore below the lower bridge plug;

unsetting the upper cement retainer and repositioning the upper cement retainer to above the wellbore zone to be squeeze cemented; and re-setting the upper cement retainer;

introducing cement through the upper cement retainer into the wellbore zone and allowing the cement introduced into the wellbore zone to harden.

12. The method of claim 11, wherein setting the lower bridge plug comprises dropping an activation ball through the drill string and the upper cement retainer to a ball seat of the lower bridge plug and pressuring the drill string.

13. The method of claim 11, wherein setting the upper cement retainer comprises:

raising the drill string to pull up the lower stinger to shear a shear pin to release the lower bridge plug; and rotating the drill string in a first direction.

14. The method of claim 13, wherein unsetting the upper cement retainer comprises rotating the drill string in a second direction opposite the first direction, wherein repositioning the upper cement retainer comprises further raising the drill string, and wherein re-setting the upper cement retainer comprises rotating the drill string in the first direction.

15. The method of claim 11, wherein the pressure testing comprises pressure testing the upper cement retainer from below, the lower bridge plug from above, and the casing between the upper cement retainer and the lower bridge plug.

* * * * *